US009435341B2

(12) United States Patent
Yamazaki et al.

(10) Patent No.: US 9,435,341 B2
(45) Date of Patent: Sep. 6, 2016

(54) SCROLL FLUID MACHINE HAVING FIXED SCROLL INCLUDING FLANGE CONTAINING GROOVE OPPOSITE THE ORBITING SCROLL THAT ABSORBS DEFORMATION DUE TO EXPANSION OF THE END PLATE

(75) Inventors: Shumpei Yamazaki, Ebina (JP); Kazutaka Suefuji, Ebina (JP); Yoshio Kobayashi, Ebina (JP); Koichi Tashiro, Chigasaki (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 124 days.

(21) Appl. No.: 13/352,542

(22) Filed: Jan. 18, 2012

(65) Prior Publication Data

US 2012/0189480 A1 Jul. 26, 2012

(30) Foreign Application Priority Data

Jan. 26, 2011 (JP) ..... 2011-013572

(51) Int. Cl.
*F04C 18/02* (2006.01)
*F04C 29/04* (2006.01)

(52) U.S. Cl.
CPC ..... *F04C 18/0253* (2013.01); *F04C 29/04* (2013.01); *F05C 2251/042* (2013.01)

(58) Field of Classification Search
USPC ..... 418/55.1–55.3, 101
See application file for complete search history.

(56) References Cited

U.S. PATENT DOCUMENTS

| | | | | |
|---|---|---|---|---|
| 6,027,321 | A * | 2/2000 | Shim et al. | 418/1 |
| 7,314,358 | B2 * | 1/2008 | Tsuchiya | 418/60 |
| 7,404,706 | B2 * | 7/2008 | Ishikawa et al. | 418/55.3 |
| 2001/0002980 | A1 * | 6/2001 | Sheridan et al. | 418/55.1 |
| 2008/0159893 | A1 * | 7/2008 | Caillat | 418/55.2 |

FOREIGN PATENT DOCUMENTS

| | | |
|---|---|---|
| CN | 101372964 (A) | 2/2009 |
| JP | 2003-97462 A | 4/2003 |
| JP | 2003-97462 (A) | 4/2003 |
| JP | 2008-051034 A | 3/2008 |
| SU | 846886 | 7/1981 |

OTHER PUBLICATIONS

English Machine Translation of JP 2003-97462 A.*

(Continued)

*Primary Examiner* — Jesse Bogue
*Assistant Examiner* — Paul Thiede
(74) *Attorney, Agent, or Firm* — Crowell & Moring LLP

(57) ABSTRACT

A scroll fluid machine includes: a casing; a fixed scroll having an end plate, a spiral wrap part provided on the end plate, and a flange provided outside the wrap part and fitted to the casing; and an orbiting scroll having an end plate and a spiral wrap part provided on the end plate with a plurality of compression chambers formed in a space up to the wrap part of the fixed scroll, which is provided to perform an orbiting motion, wherein the flange is provided with a deformation absorbing part which absorbs deformation due to thermal expansion of the end plate. The scroll fluid machine is improved in reliability while the compression efficiency is maintained by preventing the fixed scroll and the orbiting scroll from coming into contact with each other without increasing a clearance between the wrap parts of both scrolls.

8 Claims, 7 Drawing Sheets

(56) References Cited

OTHER PUBLICATIONS

Office Action in Chinese Patent Application No. 201210018015.1 dated Mar. 5, 2014.

* cited by examiner

SCROLL FLUID MACHINE HAVING FIXED SCROLL INCLUDING FLANGE CONTAINING GROOVE OPPOSITE THE ORBITING SCROLL THAT ABSORBS DEFORMATION DUE TO EXPANSION OF THE END PLATE

This application claims the priority of Japanese Patent Application No. JP 2011-013572, filed Jan. 26, 2011, the disclosure of which is expressly incorporated by reference herein in its entirety.

BACKGROUND OF THE INVENTION

1. Field of the Invention

The present invention relates to a scroll fluid machine, which is used as a compressor, for example.

2. Description of the Related Art

Generally in the scroll fluid machine, deformation is caused in the wrap parts of a fixed scroll and an orbiting scroll due to compression heat of a fluid, so that the wrap parts of the fixed scroll and the orbiting scroll come into contact with each other to cause lowering of reliability due to abrasion and generation of noise.

JP-A No. 2003-97462 discloses a scroll fluid machine, which prevents contact by making smaller the wrap tooth thickness on the cooling air downstream side rising to a high temperature and largely deformed, and enlarging a clearance between the wrap parts.

JP-A No. 2008-51034 discloses a scroll fluid machine, in which an inner peripheral side groove, an outer peripheral groove and a communicating groove are formed in a sliding surface on the outer peripheral part of a fixed scroll with an orbiting scroll.

In the scroll fluid machine described in JP-A No. 2003-97462, since a flange of the fixed scroll is fastened to a casing, a fixed scroll end plate is bent due to thermal expansion and the wrap inclines inwards. This deformation is largest on the outermost peripheral side integrated with the flange, so machining for preventing contact between the wraps should be made larger as compared with the inner peripheral side. This machining is decided depending on the maximum deformation amount at the highest temperature when the compressor is continuously operated approximately at the maximum allowable working pressure. Consequently the clearance between the wraps is large in an operation mode in which the wraps do not reach the assumed highest temperature such as the operation immediately after starting of the compressor and the intermittent operation of repeating the operation and the stop, so that it is impossible to maintain the compression efficiency.

In the scroll fluid machine described in JP-A No. 2008-51034, a projecting part is not formed on the back of the inner peripheral side groove, an outer peripheral side groove and the communicating groove formed in the sliding surface of the outer peripheral part of the fixed scroll with the orbiting scroll. Consequently when the fixed scroll end plate is thermally expanded, deformation due to the thermal expansion cannot be absorbed in the flange part, so that the wrap inclines inwards to come into contact with a wrap part of the orbiting scroll. Therefore, in order to secure the reliability, for example, machining for preventing the wrap contact as in JP-A No. 2003-97462 is needed, and it is impossible to maintain the compression efficiency.

The present invention has been made in the light of the above problem and it is an object of the present invention to provide a scroll fluid machine, which is improved in reliability while the compression efficiency is maintained by preventing a fixed scroll and an orbiting scroll from coming into contact with each other without increasing a clearance between wrap parts of both scrolls.

SUMMARY OF THE INVENTION

In order to address the above-mentioned object, according to one aspect of the invention, there is provided a scroll fluid machine including: a casing; a fixed scroll having an end plate, a spiral wrap part provided on the end plate, and a flange provided outside the wrap part and fitted to the casing; and an orbiting scroll having an end plate and a spiral wrap part provided on the end plate with a plurality of compression chambers formed in a space up to the wrap part of the fixed scroll, which is provided to perform an orbiting motion, wherein the flange is provided with a deformation absorbing part which absorbs deformation due to thermal expansion of the end plate.

According to the present invention, it is possible to provide a scroll fluid machine, which is improved in reliability while the compression efficiency is maintained by preventing a fixed scroll and an orbiting scroll from coming into contact with each other without increasing a clearance between wrap parts of both scrolls.

BRIEF DESCRIPTION OF THE SEVERAL VIEWS OF THE DRAWINGS

These and other features of the present invention will become readily apparent when considered in reference to the following detailed description when taken in conjunction with the accompanying drawings.

Preferred embodiments of the invention will be described in detail based on the followings, wherein.

DETAILED DESCRIPTION OF THE INVENTION

As a scroll fluid machine according to the embodiments of the present invention, a scroll air compressor is taken as an example and will be described in detail according to the attached drawings.

First Embodiment

The first embodiment of the present invention will now be described with reference to FIGS. 1 to 7.

Figure 1:
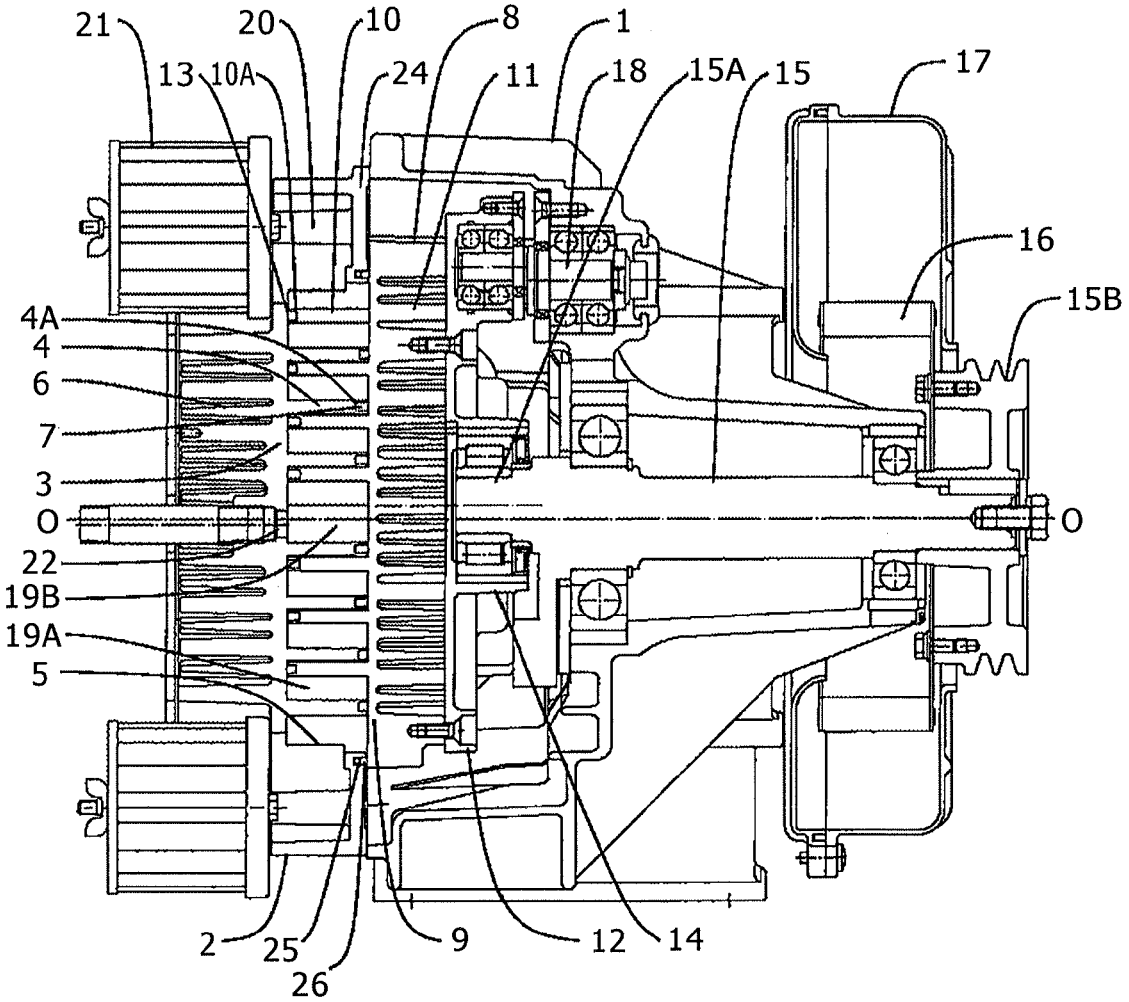
FIG. 1 is a sectional view of a scroll fluid machine.
Figure 2:
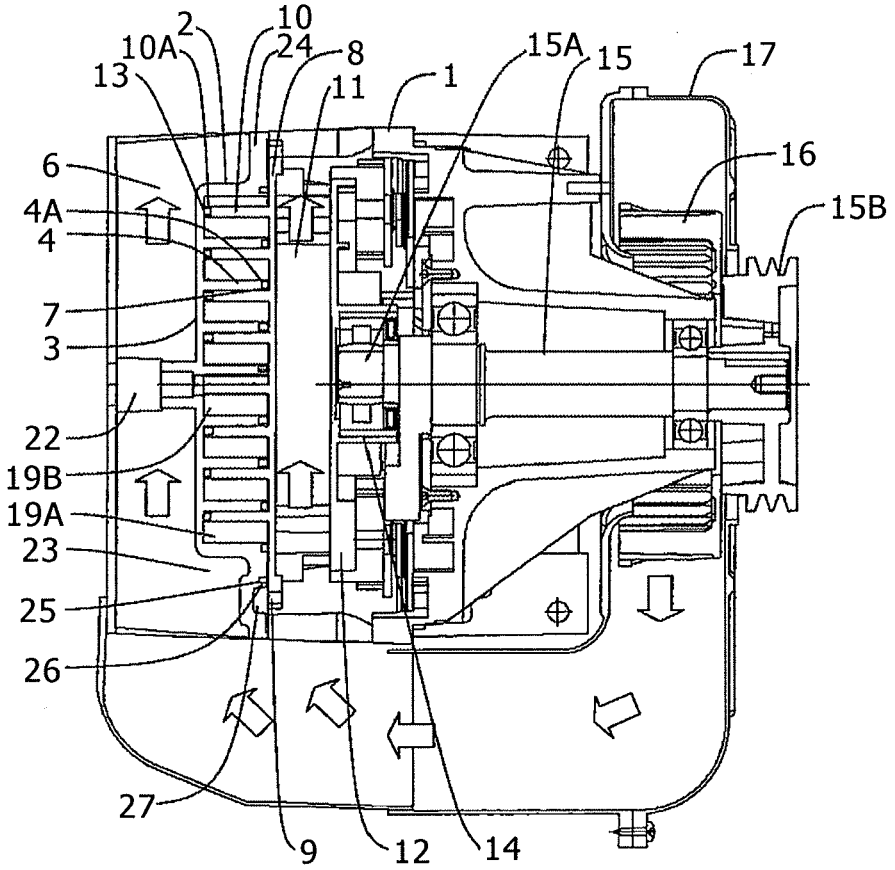
FIG. 2 is a diagram showing the flow of cooling air of the scroll fluid machine.
Figure 3:
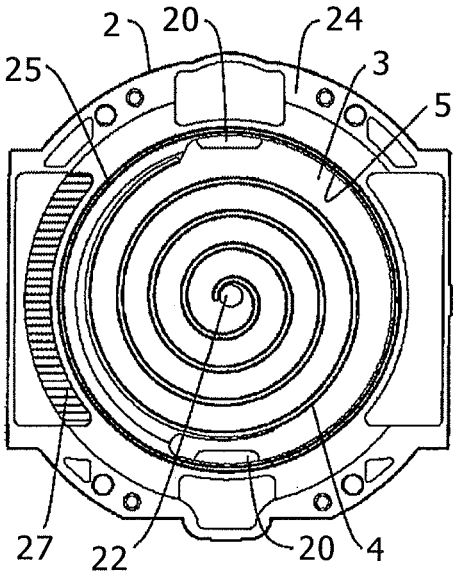
FIG. 3 is a front view of a fixed scroll according to a first embodiment of the present invention.
Figure 4:
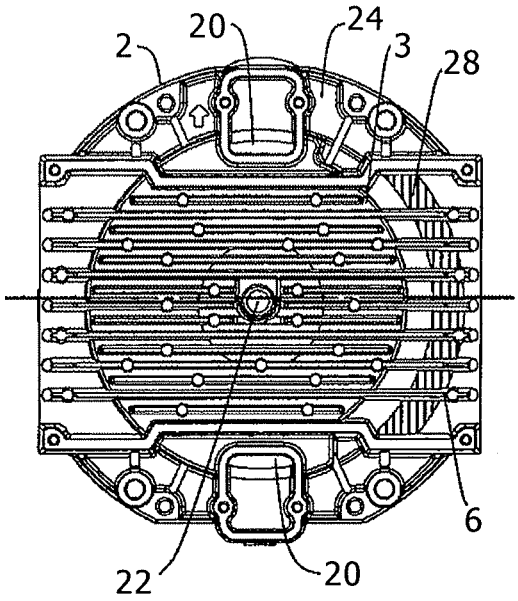
FIG. 4 is a back view of the fixed scroll according to the first embodiment of the present invention.

A sectional view of a scroll fluid machine according to the first embodiment is shown in FIG. 1. A sectional view of the scroll fluid machine according to the present embodiment taken at an angle different from that of FIG. 1 is shown with the flow of cooling air in FIG. 2. FIG. 3 shows a fixed scroll 2 as viewed from the face provided with a wrap part 4 of an end plate 3 in the present embodiment. FIG. 4 shows the fixed scroll 2 as viewed from the back of FIG. 3 in the present embodiment.

A casing 1 of a scroll air compressor is formed cylindrical and a driving shaft 15 mentioned later is rotatably supported in the interior thereof.

The fixed scroll 2 provided on the opening side of the casing 1 is, as shown in FIG. 1, generally constituted by an end plate 3 formed substantially like a disk around an axis O-O, a spiral wrap part 4 axially erected on a bottom land serving as the surface of the end plate 3, a cylindrical outer peripheral wall part 5 provided on the outside diameter side of the end plate 3 to surround the wrap part 4 and a plurality of cooling fins 6 projected on the rear of the end plate 3.

In this case, the wrap part 4 is wound spirally with about three turns from the inside diameter side toward the outside diameter side, for example, when the innermost diameter end is taken as the winding start end and the outermost diameter end is taken as the winding end. A tooth crest of the wrap part 4 is separated from the bottom land of an end plate 9 of an orbiting scroll 8, which is a counterpart, by a fixed axial dimension.

The tooth crest of the wrap part 4 is provided with a seal groove 4A along the winding direction of the wrap part 4, and a tip seal 7 as a sealing member brought into sliding contact with the end plate 9 of the orbiting scroll 8 is provided in the seal groove 4A. Further the outer peripheral wall part 5 is substantially circular and opened to the end face of the fixed scroll 2. The outer peripheral wall part 5 is disposed on the outside diameter side of a wrap part 10 in order to avoid interference with the wrap part 10 of the orbiting scroll 8.

The orbiting scroll 8 provided to perform orbiting motion in the casing 1 is generally constituted by a substantially circular end plate 9 disposed opposite to the end plate 3 of the fixed scroll 6, a spiral wrap part 10 erected at the bottom land which is the surface of the end plate 9, a plurality of cooling fins 11 projected on the back of the end plate 9, and a back plate 12 located at the tip sides of the cooling fins 11 and fixed.

In this case, the wrap part 10 is formed spiral with about three turns substantially similarly to the wrap part 4 of the fixed scroll 2. The tooth crest of the wrap part 10 is separated from the bottom land of the end plate 3 of the fixed scroll 2 as the counterpart by a fixed axial dimension. The tooth crest of the wrap part 10 is provided with a seal groove 10A along the winding direction of the wrap part 10, and a tip seal 13 as a sealing member brought into sliding contact with the end plate 3 of the fixed scroll 2 is provided in the seal groove 10A.

A cylindrical boss part 14 rotatably connected to a crank part 15A of the driving shaft 15 through a swivel bearing or the like is integrally formed on the center side of the rear plate 12. At one end side of the driving shaft 15, a pulley 15B is provided to locate on the outside of the casing 1, and the pulley 15B is connected to the output side of an electric motor as a driving source, for example, through a belt (both are not shown). Thus, the driving shaft 15 is driven in rotation by the electric motor or the like, thereby causing the orbiting scroll 8 to perform orbiting motion to the fixed scroll 2.

A cooling fan 16 is fitted to the pulley 15B using a bolt or the like, and the cooling fan 16 generates cooling air in a fan casing 17. Thus, as shown in FIG. 2, the cooling fan 16 blows the cooling air along a duct or the like in the fan casing 17 to the interior of the casing 1 and the rear sides of the respective scrolls 2, 8, thereby cooling the casing 1, the fixed scroll 2, the orbiting scroll 8 and the like.

Further, three auxiliary cranks 18 (only one is shown), for example, for preventing rotation of the orbiting scroll 8 are provided between the outside diameter side of the rear plate 12 and the casing 1.

A plurality of compression chambers 19 provided between the fixed scroll 2 and the orbiting scroll 8 are sequentially formed extending from the outside diameter side to the inside diameter side to locate between the wrap parts 4, 10, and kept air-tight by the tip seals 7, 13. Each compression chamber 19 is continuously reduced between the wrap parts 4, 10 while moving from the outside diameter sides to the inside diameter sides of the wrap parts 4, 10 when the orbiting scroll 8 performs orbiting motion in the forward direction.

Thus, external air is sucked from a suction opening 20 mentioned later into the compression chamber 19A among the compression chambers 19 that is located at the most outside diameter side, and the air is compressed before it reaches the compression chamber 19B located at the most inside diameter side to become compressed air. The compressed air is delivered from a discharge opening 22, and stored in an external storage tank (not shown).

The suction opening 20 provided on the outside diameter side of the fixed scroll 2 is opened extending from the outside diameter side of the end plate 3 to the outer peripheral wall part 5 to communicate with the compression chamber 19A located at the most outside diameter side. The suction opening 20 is located at the outside diameter side of the wrap part 10 of the orbiting scroll 8 in the end plate 3 of the fixed scroll 2, and opened within a range where the tip seal 13 is not brought into sliding contact (a non-sliding range). The suction opening 20 sucks the air at atmospheric pressure, for example, through a suction filter 21 into the compression chamber 19A located at the most outside diameter side.

The suction opening 20 may be configured to suck the pressurized air. In this case, the suction filter 21 may be removed and the suction opening 20 may be connected to piping supplied with the pressurized air.

The discharge opening 22 provided on the inside diameter side (the center side) of the end plate 3 of the fixed scroll 2 communicates with the compression chamber 19B located at the most inside diameter side to discharge the compressed air in the compression chamber 19B to the outside.

A flange 24 located on the outer peripheral side from the wrap part 4 fixes the fixed scroll 2 to the casing 1.

A face seal groove 25 provided in the end face of the fixed scroll 2 confronting the end plate 9 of the orbiting scroll 8 is located on the outside diameter side of the outer peripheral wall part 5 and formed annularly to surround the outer peripheral wall part 5. An annular face seal 26 is fitted in the face seal groove 25. The face seal 26 air-tightly seals between the end face of the fixed scroll 2 and the end plate 9 of the orbiting scroll 8, thereby preventing the air sucked in the outer peripheral wall part 5 from leaking between them.

A recessed groove 27 provided in a face of the flange 24 of the fixed scroll 2 that is opposite to the orbiting scroll 8 is provided inside a part to which the casing 1 is fitted. A projecting part 28 is provided on the back of the recessed groove 27. The recessed groove 27 and the projecting part 28 constitute a deformation absorbing part for absorbing deformation due to thermal expansion of the end plate 3, thereby preventing such a deformation that the most outside diameter part of the wrap part 4 inclines toward the inner periphery side.

The scroll air compressor according to the present embodiment is configured as described above, and the operation of the scroll air compressor will now be described.

First, when the driving shaft 15 is driven in rotation by the driving source (not shown) such as an electric motor, the orbiting scroll 8 performs orbiting motion around the axis O-O of the driving shaft 15 in the state of being prevented from rotation by a rotation preventing mechanism, and the compression chambers 19 partitioned between the wrap part 4 of the fixed scroll 2 and the wrap part 10 of the orbiting scroll 8 are continuously reduced. Thus, the air sucked from the suction opening 20 of the fixed scroll 2 can be delivered as the compressed air from the discharge opening 20 of the fixed scroll 2 toward the external tank (not shown) while being compressed in the respective compression chambers 19 sequentially.

Figure 5:
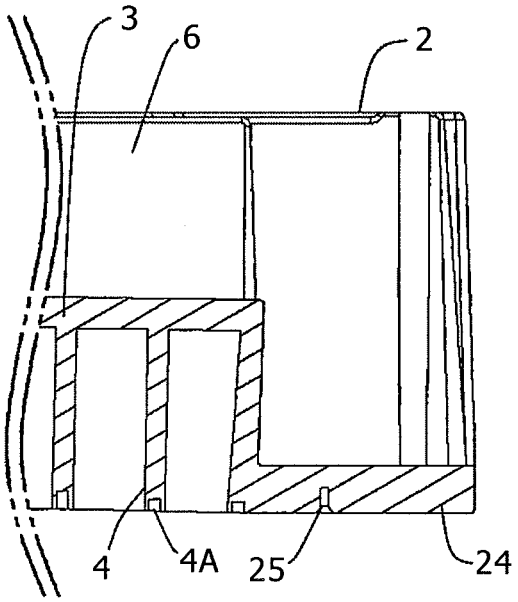
FIG. 5 is a diagram showing thermal deformation of the fixed scroll in the case where any recessed groove is not provided.
Figure 6:
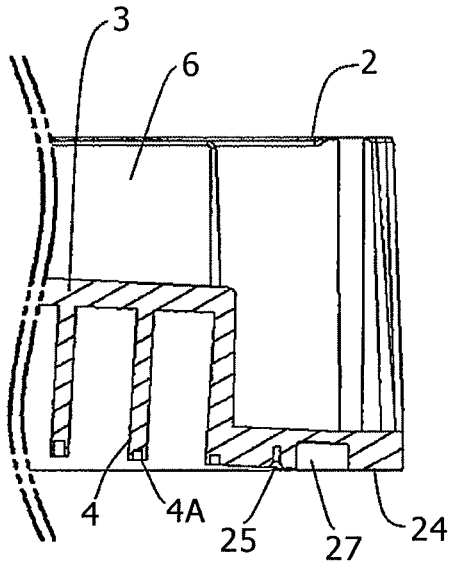
FIG. 6 is a diagram showing thermal deformation of the fixed scroll in the case where any projecting part is not provided.
Figure 7:
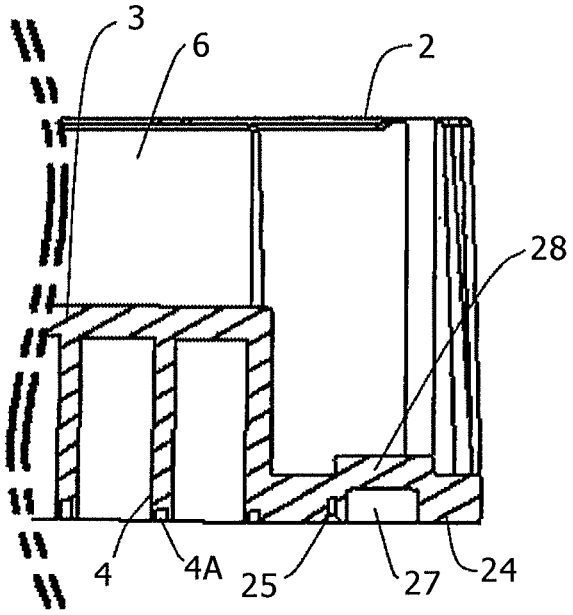
FIG. 7 is a diagram showing thermal deformation of the fixed scroll according to the first embodiment of the invention.

The deformation of the fixed scroll 2 due to heat generated by the compressing operation will be described using FIGS. 5, 6 and 7. FIGS. 5 to 7 are sectional views as the fixed scroll 2 is viewed with the end plate 3 on the upside and with the wrap part 4 on the lower side. FIG. 5 is a diagram showing the thermal deformation of the fixed roll 2 in the case where the recessed groove 27 and the projecting part 28 are not provided on the flange 24. FIG. 6 is a diagram showing the thermal deformation of the fixed scroll 2 in the case where the recessed groove 27 is provided in the flange 24 and the projecting part 28 is not provided on the flange 24. FIG. 7 is a diagram showing the thermal deformation of the fixed scroll 2 in the present embodiment.

As shown in FIG. 5, in the case where the recessed groove 27 and the projecting part 28 are not provided on the flange 24, the end plate 3 of the fixed scroll 2 is deformed to the right in FIG. 5 by the thermal expansion. On the other hand, since the flange 24 of the fixed scroll 2 is fixed to the casing 1 against the thermal expansion of the end plate 3, the deformation is restrained, and bracing is caused by the end plate 3 and the flange 24 so that the end plate 3 is, as shown in FIG. 5, bent and the wrap 4 inclines inwards. This deformation becomes largest at the outermost peripheral side integrated with the flange 24. In order to prevent contact between the wrap 4 of the fixed scroll 2 and the wrap 10 of the orbiting scroll 8 due to this deformation, as shown in JP-A No. 2003-97462, for example, machining is performed to make the tooth thickness thinner for the thermal deformation amount, thereby providing a suitable clearance between the wraps 8, 10 to cope with the contact problem. Since the size of the clearance is decided depending on the maximum deformation amount at the highest temperature when the compressor is continuously operated approximately at the maximum allowable working pressure, the clearance between the wraps 4, 10 becomes large in an operation mode in which the wraps 4, 10 do not reach the assumed highest temperature such as the operation immediately after starting of the compressor from cold working and the intermittent operation of repeating the operation and the stop, resulting in worsening the compression efficiency.

In the case where only the recessed groove is provided in the flange 24 and the projecting part is not provided as shown in FIG. 6, the rigidity of the flange 24 is high so that the deformation of the fixed scroll 2 due to thermal expansion cannot be absorbed. On the other hand, in the case of forming the recessed groove deep in order to lower the rigidity, a portion of the recessed groove is deformed to bend toward the orbiting scroll 8 (downward in FIG. 6), so that bracing of the flange 24 cannot be released and the wrap 4 cannot be prevented from inclining inwards.

Then, according to the present embodiment, as shown in FIG. 7, the flange 24 of the fixed scroll 2 is provided with the recessed groove 27, and further the projecting part 28 is provided on a portion opposite to the recessed groove 27. The recessed groove 27 in the flange 24 is provided in the face opposite to the orbiting scroll 8, and the back of the portion of the flange 24 provided with the recessed groove 27 is projected over the outer edge part of the flange 24 on the opposite side to the orbiting scroll 8. A portion constituted by the recessed groove 27 and the projecting part 28 is deformed to bend toward the opposite side to the orbiting scroll 8 (bend upward in FIG. 7), whereby bracing due to deformation caused by thermal expansion of the end plate 3 and the flange 24 is released to reduce bending of the end plate 3 so that the wrap 4 can be prevented from inclining inwards. Thus, the above machining for preventing contact between the wraps can be decreased and the clearance between the wraps can be kept to the minimum even in the operation mode in which the wraps 4, 10 do not reach the highest temperature to improve the performance of the compressor.

The recessed groove 27 and the projecting part 28 are, as shown in FIG. 4, provided within a predetermined range of an angle from the center of the fixed scroll 2 to intersect the extending direction of the cooling fin 6, not extending over the whole periphery of the flange 24. The rigidity of the end plate 3 is made higher in the vertical direction to the extending direction of the cooling fin 6 than that in the extending direction of the cooling fin 6. Therefore, the thermal expansion in the extending direction of the cooling fin 6 is larger than the thermal expansion in the vertical direction to the extending direction of the cooling fin 6. Thus, the recessed groove 27 and the projecting part 28 are provided only within the predetermined range of an angle from the center of the fixed scroll 2 to intersect the extending direction of the cooling fin 6 as shown in FIG. 4, the thermal expansion of which is especially great, whereby the influence of thermal expansion can be restrained with less machining.

Second Embodiment

A second embodiment of the present invention will be described using FIGS. 8-11. The feature of the present embodiment is that the projecting part 28 of the first embodiment is an inclined part 23 smoothly connecting the end part of an end plate 3 and a flange 24, thereby causing the cooling air on the rear of a fixed scroll 2 to flow without generating a vortex as mentioned later so that the cooling efficiency is improved.

Figure 8:
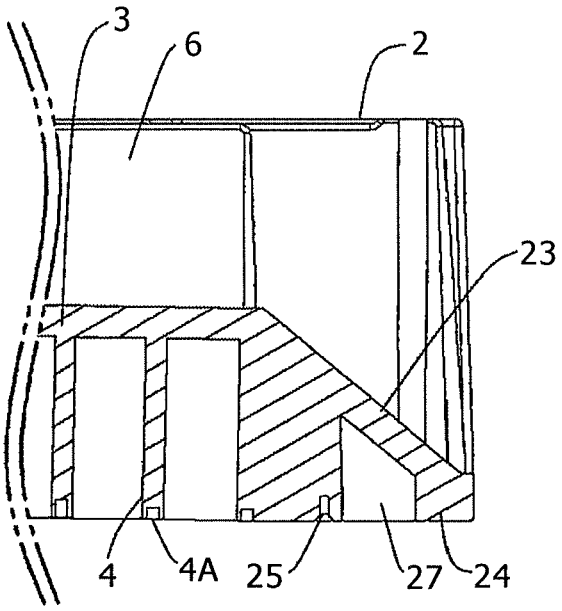
FIG. 8 is a sectional view of a fixed scroll according to a second embodiment of the present invention.

FIG. 8 is a sectional view of the fixed scroll 2 as viewed with a wrap part 4 on the lower side in the present embodiment. In the present embodiment, as shown in FIG. 8, a deformation absorbing part for absorbing deformation due to thermal expansion of the end plate 3 is formed by the inclined part 23 smoothly connecting the end part of the end plate 3 and the flange 24 and a recessed groove 27. The groove bottom of the recessed groove 27 is also inclined according to the inclined part 23. Thus, even if the end plate 3 thermally expands in the lateral direction, the rigidity is made lower in the lateral direction of the inclined part 23, so that similarly to the first embodiment, bracing can be released by deformation due to thermal expansion of the end plate 3 and the flange 24 to decrease bending of the end plate 3 and prevent a wrap 4 from inclining inwards.

Figure 10:
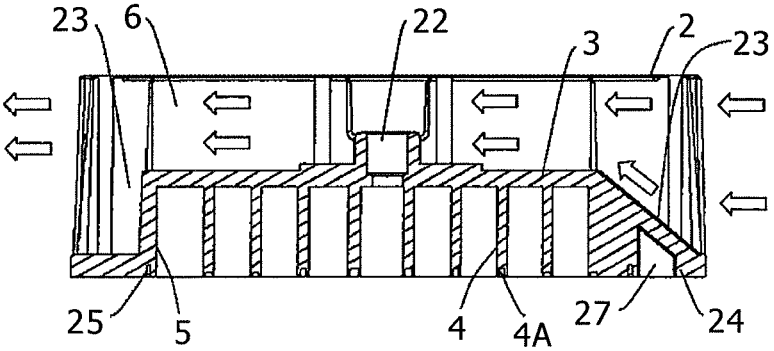
FIG. 10 is a diagram showing the flow of cooling air of the present invention in accordance with the second embodiment of the invention.

Further, in the present embodiment, the cooling air, which is generated by a cooling fan 16 and has reached the rear of the fixed scroll along a duct or the like in a fan casing 17 flows along the inclined part 23 smoothly connecting the back of the end plate 3 and the flange part 24 as shown in FIG. 10. Therefore, according to the present embodiment, in addition to the effect of the first embodiment, as shown in FIG. 10, the cooling air can flow in the vicinity of the end plate 3 of the fixed scroll 2 without inhibition of vortex generated in the structure where the inclined part 23 is not provided, so that efficient cooling can be performed.

Figure 9:
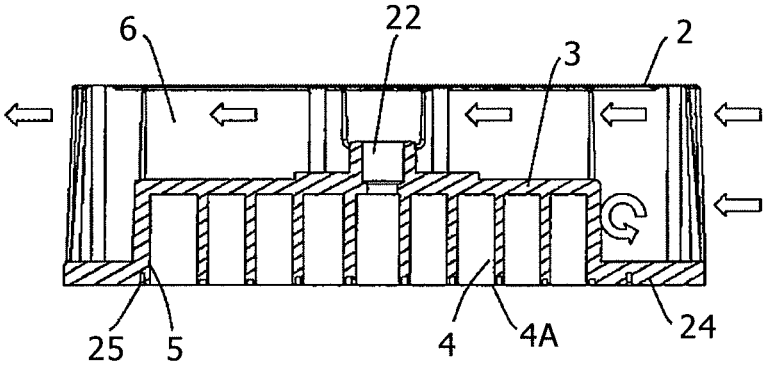
FIG. 9 is a diagram showing the flow of cooling air of the fixed scroll constructed so that an inclined part is not provided on a flange.

On the other hand, in the structure shown in FIG. 9 where the inclined part 23 is not provided, the cooling air, which is generated by the cooling fan 16 and has reached the rear of the fixed scroll along the duct or the like in the fan casing 17 is inhibited from flowing by a vortex generated by a step part between the rear part of the end plate 3 and the flange 24 and also caused to flow through a part away from the end plate 3 of the fixed scroll 2 so that efficient cooling cannot be performed.

Figure 11:
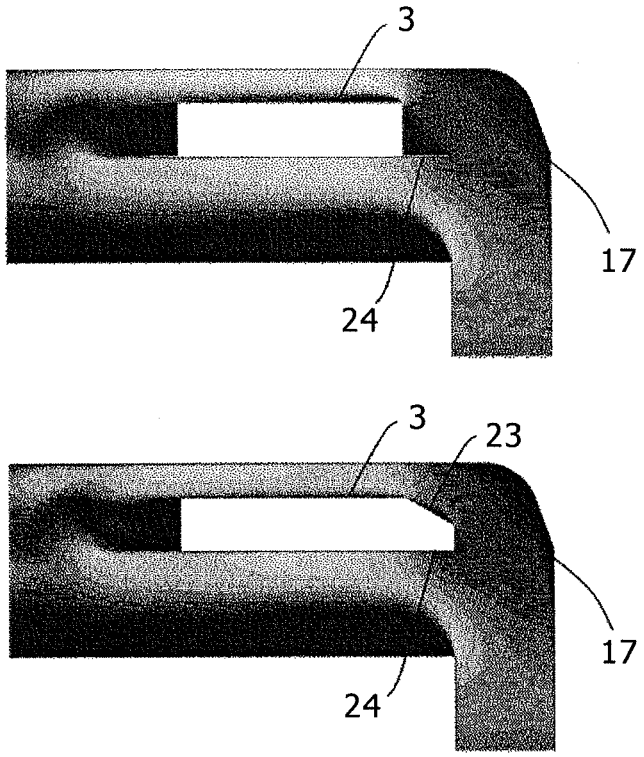
FIG. 11 is a diagram showing the analysis result of speed of cooling air flowing in the periphery of the fixed scroll.

FIG. 11 shows a two-dimensional model of a flow velocity of cooling air in the periphery of the fixed scroll 2 in the case where the cooling air is caused to flow with the same conditions in the fan casing 17 and the fixed scroll 2. In FIG. 11, the lighter the color is, the higher the flow velocity of the cooling air is, and the thicker the color is, the lower the flow velocity is. The fixed scroll 2 of the structure without the inclined part 23 is shown in the upper part of FIG. 11, and the fixed scroll 2 constructed so that a smooth inclined part 23 is provided on the step part between the rear part of the end plate 3 and the flange 24 is shown in the lower part of FIG. 11.

In the fixed scroll 2 of the structure without the inclined part 23, a vortex is generated at the step part between the rear part of the end plate 3 and the flange 24, and as can be seen from the upper diagram of FIG. 11, although the flow velocity in a part away from the end plate 3 is high, the flow velocity in the vicinity of the end plate 3 is not high. On the other hand, in the case where the smooth inclined part is provided on the step part between the rear part of the end plate 3 and the flange 24, as can be seen from the lower diagram of FIG. 11, the cooling air flows along the inclined part, and the flow velocity in the vicinity of the end plate 3 is higher than that in the structure without the inclined part 23.

Therefore, in the present embodiment, the deformation of the fixed scroll 2 due to heat generated by the compression operation is decreased and bracing is decreased by the end plate 3 and the flange 24, so that the above machining for preventing contact between the wraps can be further reduced. Therefore, the performance of the compressor can be improved even in the operation mode in which the wraps 4, 10 do not reach the assumed highest temperature.

Further, as shown in FIG. 4, also in the present embodiment, similarly to the first embodiment, the recessed groove 27, the projecting part 28 and the inclined part 23 are provided within a predetermined range of an angle from the center of the fixed scroll 2 to intersect the extending direction of the cooling fin 6, not extending over the whole periphery of the flange 24. Thus, the cooling air at the rear part of the end plate 3 of the fixed scroll 2 flows along the spaces between the plurality of cooling fins 16 so that the cooling air can be efficiently circulated to the rear part of the end plate 3 of the fixed scroll 2. Furthermore, since the inclined part 23 is partly provided, not extending over the whole periphery of the flange 24, an increase in weight of the product can be restrained.

Third Embodiment

Figure 12:
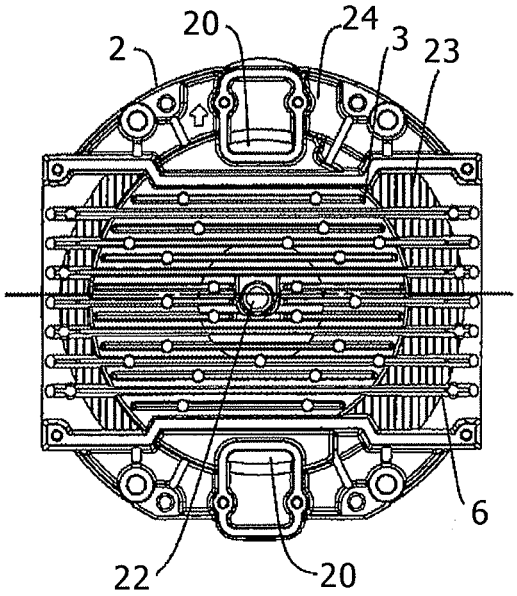
FIG. 12 is a back view of a fixed scroll according to a third embodiment of the present invention.

A third embodiment of the present invention will be described using FIGS. 12-13. The feature of the present embodiment is, as shown in FIG. 12, that the recessed part 27 and the projecting part 28 on the back or the inclined part 23 described above is provided on both a flange 24 on the inflow side of the cooling air and a flange located on the opposite side, thereby attaining the effect described in the first embodiment and the second embodiment more greatly.

Figure 13:
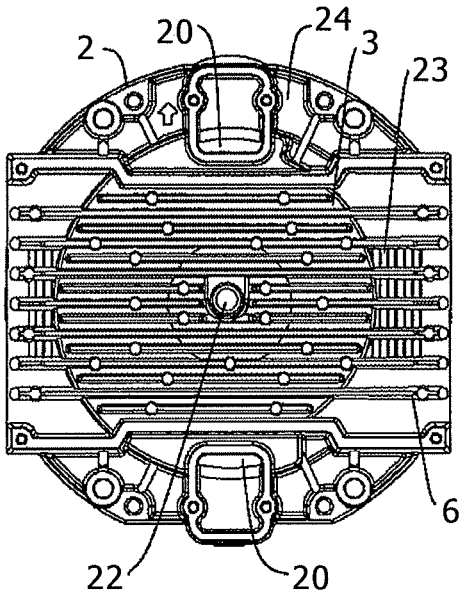
FIG. 13 is a back view of the fixed scroll according to the third embodiment of the present invention.

As shown in FIG. 13, the recessed groove 27 and the projecting part 28 or the inclined part 23 is provided only on the part that should be most cooled, whereby the above cooling air flow can be improved only in the part that requires prevention of thermal deformation so that the performance of the compressor in the above operation mode can be improved in the simple constitution.

Furthermore, the inclined part 23 is formed by another member, whereby in a product using the same fixed scroll and different in output, it is possible to change the number of the inclined parts 23 formed by another member or change the inclination itself, so that the thermal deformation can be prevented effectively. Further, the inclination 23 is formed of resin material or the like having a lower specific gravity than the fixed scroll so that the above effect can be obtained and an increase in weight of the product can be prevented.

Although the descriptions of the respective embodiments deal with an example of application to the scroll air compressor as the scroll fluid machine, the present invention is not limited to this, but may be applied to another scroll fluid machine such as a refrigerant compressor configured to compress a refrigerant and a vacuum pump. Further it may be applied to systems such as a tank integrated type package compressor and a nitrogen gas generator.

The described embodiments are to be considered as illustrative and these are not restrictive in technical scope of the present invention. That is, the present invention may be implemented in various modes without departing from the technical idea or the principal feature. Further, the first embodiment to the third embodiment may be combined to implement the present invention.

What is claimed is:

1. A scroll fluid machine, comprising:

a casing supporting a drive shaft;

a fixed scroll having an end plate, a spiral wrap part provided on the end plate of the fixed scroll, and a flange provided outside the wrap part and fitted to the casing, the flange being a deformation absorbing part including a recessed groove and a projecting part and having radially inner and outer parts that are respectively adjacent to the projecting part; and an orbiting scroll having an end plate and a spiral wrap part provided on the end plate of the orbiting scroll with a plurality of compression chambers formed in a space up to the wrap part of the fixed scroll, the orbiting scroll provided to perform an orbiting motion, wherein the recessed groove is provided in a face of the flange and has an adjacent, opposing relationship to the end plate of the orbiting scroll and the projecting part is provided on a surface of the flange opposite to the face of the flange that faces the orbiting scroll, the radially inner part has a surface that faces away from the orbiting scroll and the radially outer part also has a surface that faces away from the orbiting scroll, the projecting part defines a surface that is disposed in between the radially inner part and the radially outer part and the projecting part projects axially beyond the radially inner part and the radially outer part, and the recessed groove is recessed axially relative to the radially inner part and the radially outer part.

2. The scroll fluid machine according to claim 1, further comprising a cooling fan for cooling the fixed scroll and the orbiting scroll.

3. The scroll fluid machine according to claim 1, wherein a plurality of cooling fins are provided on a rear of the end plate of the fixed scroll.

4. The scroll fluid machine according to claim 1, wherein the recessed groove is provided inside a part of the flange that is fitted to the casing.

5. A scroll fluid machine, comprising:

a casing;

an orbiting scroll; and a fixed scroll having an end plate and a spiral wrap part provided on the end plate and a flange provided outside the spiral wrap part and fitted to the casing, the flange having a first surface facing towards the orbiting scroll and a second surface opposing the first surface, the flange being provided with a recessed groove in a face of the flange of the fixed scroll and the face of the flange and the recessed groove both having an adjacent, opposing relationship with the orbiting scroll, the first surface of the flange being disposed in the recessed groove spaced apart from the face of the flange, wherein the orbiting scroll performs an orbiting motion opposite to the fixed scroll, and wherein both the first surface of the flange and the second surface of the flange, respectively, have a non-parallel, inclined relationship with respect to the face of the flange of the fixed scroll that opposes the orbiting scroll.

6. The scroll fluid machine according to claim 5, further comprising a cooling fan for cooling the fixed scroll and the orbiting scroll.

7. The scroll fluid machine according to claim 6, wherein the first and second surfaces are provided on the flange at an inflow side of cooling air.

8. The scroll fluid machine according to claim 6, wherein a plurality of cooling fins are provided on faces of the fixed scroll and the orbiting scroll that are oriented away from one another in opposite directions.

* * * * *